United States Patent [19]

Zumstein et al.

[11] Patent Number: 4,831,718

[45] Date of Patent: May 23, 1989

[54] PROCESS FOR LAMINATING PLATE PACKS, IN PARTICULAR TRANSFORMER CORES

[75] Inventors: Bruno Zumstein, St. Gallen; Anton Angehrn, Abtwil; Beat Stahel, St. Gallen, all of Switzerland

[73] Assignee: Ulrich Steinemann AG, St. Gallen, Switzerland

[21] Appl. No.: 49,981

[22] Filed: May 15, 1987

[30] Foreign Application Priority Data

May 22, 1986 [CH] Switzerland ..... 2071/86

[51] Int. Cl.[4] ..... H01F 41/02

[52] U.S. Cl. ..... 29/609; 29/430; 29/469; 29/559; 29/738

[58] Field of Search ..... 29/609, 738, 430, 469, 29/559, 822; 414/57; 156/560, 562, 572

[56] References Cited

U.S. PATENT DOCUMENTS 4,578,860 4/1986 Tanaka ..... 29/738
4,597,172 7/1986 Bourgeois ..... 29/738 X

FOREIGN PATENT DOCUMENTS 40810 3/1983 Japan ..... 29/738
733064 5/1980 U.S.S.R. ..... 29/738

*Primary Examiner*—Carl E. Hall
*Attorney, Agent, or Firm*—William R. Hinds

[57] ABSTRACT

Positioning of the individual portions is no longer effected on the laminating station but on a positioning station which is arranged upstream of the laminating station. In the positioning station the individual portions of a layer are deposited and positioned by being pushed against each other. The finally positioned individual layer is then delivered as a closed unit to the laminating station and laminated to form a transformer core. The individual portions are stacked on a stacking station in such a way that they are already arranged in the correct relative position with respect to each other.

9 Claims, 9 Drawing Sheets

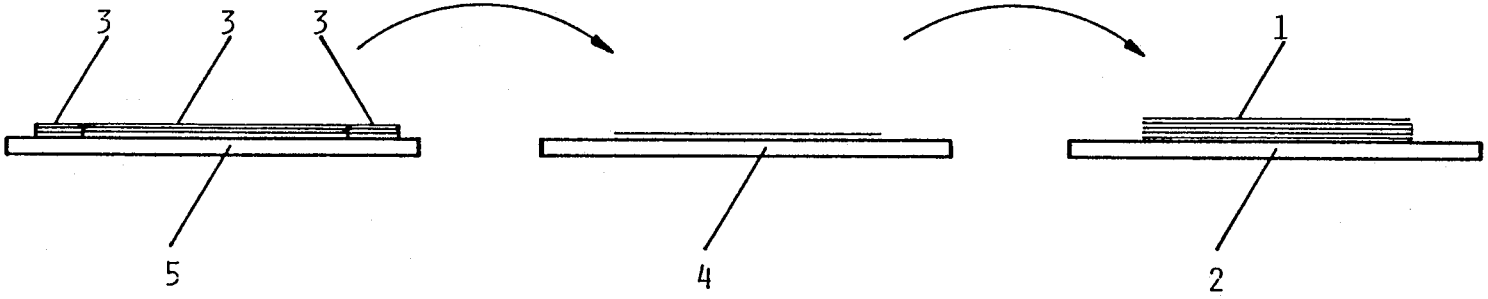
FIG. 1
FIG. 1 a
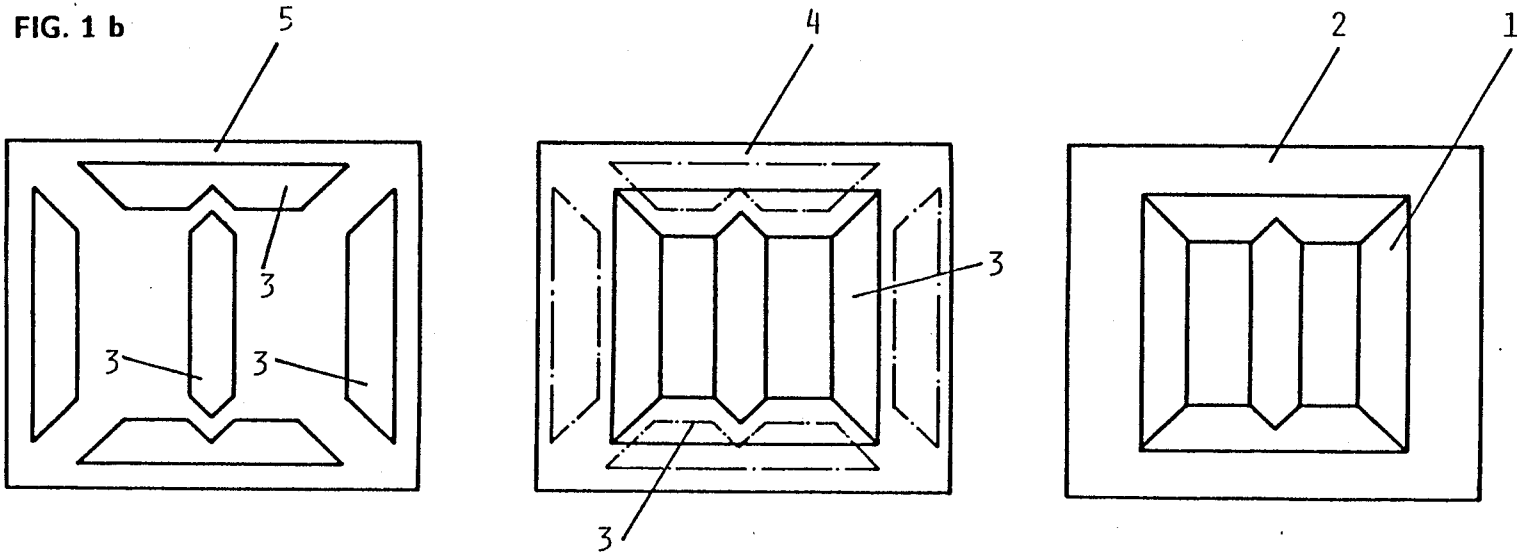
FIG. 1 b

X
Y
12
13
14
17
21
22
23

FIG. 11
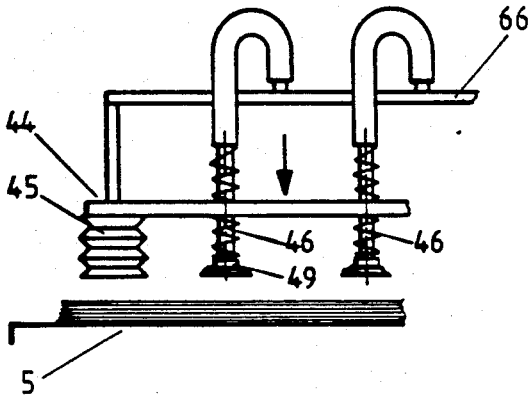
FIG. 11 a
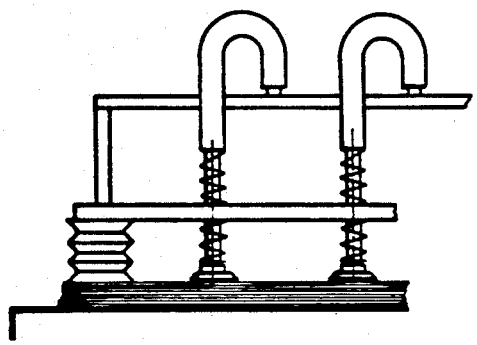
FIG. 11 b
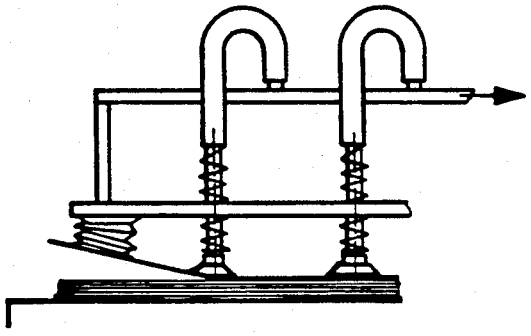
FIG. 11 c
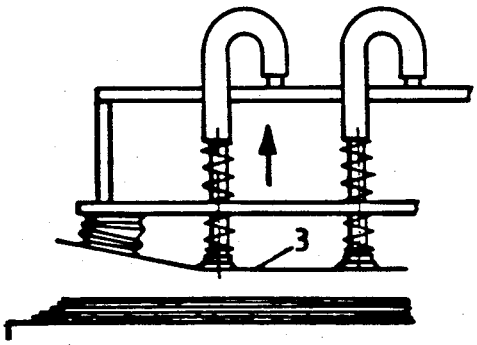
FIG. 11 d FIG. 12
FIG. 12 a
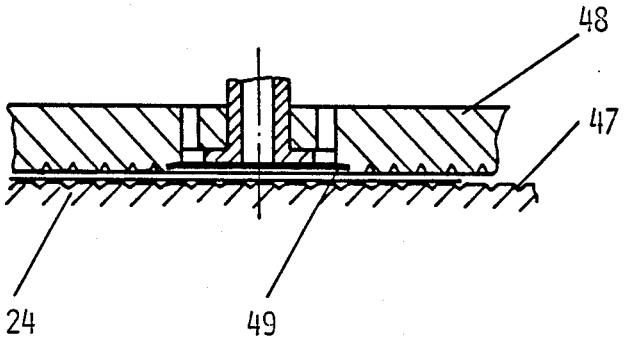
FIG. 12 b
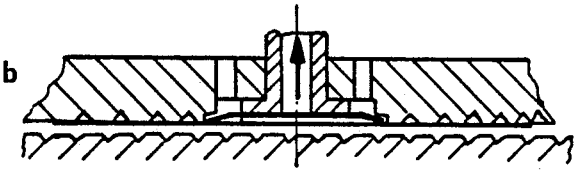
FIG. 13
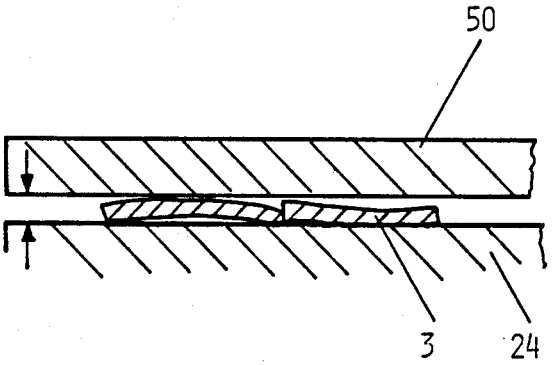
FIG. 14
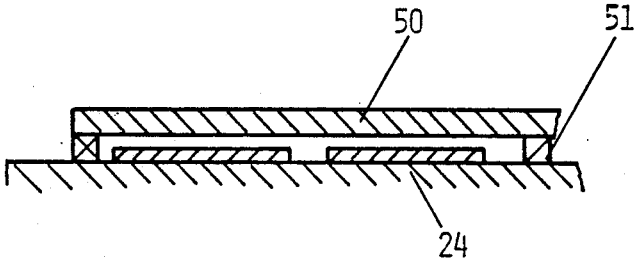

PROCESS FOR LAMINATING PLATE PACKS, IN PARTICULAR TRANSFORMER CORES

FIELD OF THE INVENTION

The invention relates to a process and an apparatus for laminating plate packs, in particular transformer cores, wherein a plurality of plate layers are laminated on a laminating station to provide a compact laminated body.

DESCRIPTION OF THE PRIOR ART

The laminated cores for distributor and power transformers with power levels of more than 30 KVA are even nowadays still laminated by hand, with few exceptions. In that connection, mechanical abutments and pre-oriented stacks which are prepared around the laminating station are used as assembly aids. An operator laminates about 6 to 30 plates per minute, depending on the size of the plates and the assembly equipment available.

Fully automatic and semi-automatic installations have also been designed for laminating the cores. In that connection, for example individual portions which have been cut to size are distributed to conveyor belts and fed to the laminating station. Individual ones of the portions which are supplied in parallel relationship have to be turned through 90° by a turning device, and put into a condition of abutment. Those installations suffer from the disadvantage that they are relatively complicated and highly expensive. Expensive conversion operations are required for conversion of the installations to plates of different dimensions, so that the installation suffers from long stoppage times. Furthermore, in most cases it is necessary for the plates to be provided with bores for the centering operation in the lamination process, and that has a disadvantageous effect in regard to the finished transformer core.

OUTLINE OF THE INVENTION

An object of the present invention is therefore to provide a process and an apparatus of the kind set forth in the opening part of this specification, which permit fully automatic lamination of plate cores at minimum expenditure and with a high level of efficiency. In that connection the invention seeks to provide that fluctuations in tolerances in regard to the outside dimensions of the plates do not have an adverse effect, that is to say they do not result in air gaps at the intersections, which would result in electrical losses in the transformer. The invention further seeks to provide that the process can also be carried out without mechanical alteration of the plates, that is to say without centering holes or the like.

In accordance with the invention, that object is achieved by a process for producing laminated plate packs consisting of individual layers each having a plurality of portions that abut against each other, the process comprising depositing the portions of one individual layer on a positioning station having a generally horizontal even support table, positioning the deposited portions on the support table in relative contiguous positions by pushing the portions together in the plane of the support table to form an individual layer of predetermined shape, and delivering the individual layer when formed to a laminating station while maintaining the predetermined shaped, and laminating the individual layer with at least one other individual layer on the laminating station by repeating the process in order to build up the plate pack on the laminating station. Related to the process, apparatus for laminating plate packs comprises a positioning station with a pushing means on which individual portions of the layer can be pushed against each other into their final position so that the positioned individual portions of the layer can be jointly transported by a gripper onto a laminating station and deposited there. The actual operations of positioning and arresting the individual portions of a layer are therefore carried out on a separate positioning station and not on the laminating station on the laminated body which has already been partially laminated. Therefore, there is no need for steps to be taken on the laminated body itself in order to prevent the individual portions from slipping as it is only individual portions which have already been positioned and fixed in their position that are deposited on the laminating station.

A further rationalisation effect is achieved if the individual portions are prepared in a stack-wise manner at a stacking station in such a way as already to be in the correct relative position with respect to each other, and if all individual portions of a respective layer are transported jointly from the stacking station on to the positioning station. In that way, by means of a single movement, all individual portions of a layer can be passed to the positioning station, which makes it possible to use a gripper system. It will be seen that that is substantially simpler than providing a feed by means of conveyor belts, roller conveyors or robot systems.

An individual layer may be positioned on the positioning station in a particularly simple manner if a respective individual portion is fixed in a predetermined position or is oriented with respect to a predetermined axis, and all other individual portions of a layer are positioned by being pushed theregainst, wherein the fixed or oriented individual portion determines the position of all individual portions which are pushed thereagainst. In that way there is no need for bores for positioning the individual portions. Tolerances in respect of length of the individual portions are automatically compensated for as the individual portions are always pushed into position until they abut against each other. In that way air gaps at the junctions are reliably eliminated. In that way three-phase transformers having three parallel limbs and two yokes may be laminated in a particularly advantageous fashion, in that firstly the centre limb is oriented with respect to a predetermined axis at the positioning station and then the two yokes and the two outer limbs are pushed into position. The junctions between the various components may be butt junctions, mortise junctions or bevel-cut junctions.

As, for the purposes of applying the coil bodies to the parallel limbs, at least one yoke has to be removed again after the laminating operation, it is also possible to provide at the positioning station a gauge or positioning yoke which always remains at the positioning station and which is only provided for orientation of the other individual portions. Therefore, a respective layer which is open at one side is transported from the positioning station to the laminating station, and laminated to provide a core which is open at one side.

Individual portions are preferably pushed into their final position with an axially symmetrical movement at the positioning station, and measured in that position by means of a measuring system. In that way any missing or wrongly dimensioned plates or plates in the wrong position can be detected. It is also possible for a measurement record to be automatically set down so that the nature of the laminated core can be checked on the basis of measurement data.

The individual layers are preferably transported from the stacking station to the positioning station by a movable gripper which bends up the ends of the individual portions when lifting them from the stacks. In that way it is possible to overcome the relatively strong adhesion force when the individual plates are lifted from the stack. Lifting and moving the plates from the stacking station does not have a disadvantageous effect as the individual portions do not have to be deposited at the positioning station in a precise position. In contrast, the layer which is in a finally positioned condition is transported from the positioning station to the laminating station by means of a rigid gripper which ensures that it is transported in a precisely plane-parallel condition, without displacement in respect of the junctions therein. The layer can be lifted in a plane-parallel condition from the positioning station without adhesion forces occurring by virtue of the fact that the positioning station has a support table with a structured surface.

The operation of positioning the layer at the positioning station may be carried out in a particularly simple manner if the positioning station has a support table with grooves and if the pushing arrangement comprises pushing elements which project out of the support table through the grooves and which are displaceable in the grooves. In that arrangement the pushing arrangement is arranged substantially beneath the support table so that there are no disturbing machine elements beside or above the positioning station. Each two co-operating pushing elements are preferably fixed to a parallel motion cable, so as to permit an axially symmetrical movement of the pushing elements towards and away from each other.

The positioning station preferably has a hold-down means for holding down ends of the individual portions which are possibly bent up when the individual portions are pushed together. That reliably ensures that any bent-up ends of individual portions do not come to lie one above the other when the individual portions are pushed together. The hold-down means is preferably directly integrated into the gripper between the positioning station and the laminating station.

A particularly high degree of automation can be achieved if four grippers are fixed in displaced relationship relative to each other at respective angles of 90°, to a turning unit which is rotatable about a vertical central axis and if two positioning stations and a respective stacking station and a respective laminating station are arranged around the central axis, also being in displaced relationship relative to each other through 90°, with the two positioning stations being disposed in mutually diametrally opposed relationship. In that arrangement transportation from the stacking station by way of the positioning station to the laminating station takes place in a continuous alternating swinging movement, wherein a layer is always being supplied to and positioned on a positioning station and then lifted off and transported to the laminating station in the next-but-one cycle. Each individual swinging movement thus performs a function. It is possible further to optimise the manufacturing procedure if different stacking tables can be selectively moved to the stacking station. In that way the prepared stacks can be automatically supplied cn different tables, for the various stages of a core cross-section. That makes it possible for multi-stage cores to be manufactured in a practically fully automatic manner without stoppage times for conversion operations and the like.

DESCRIPTION OF THE DRAWINGS

Embodiments of the invention are described in greater detail hereinafter and illustrated in the accompanying drawings in which:

FIGS. 1, 1*a* and 1*b* consisting of subfigures 1*a* and 1*b* are a diagrammatic view of the operating procedure in the laminating operation;

FIGS. 11*a*–11*d* show the operation of lifting an individual layer from the stacking station with a movable gripper in four stages;

FIGS. 12*a*–12*b* show in cross-section a gripper arrangement and a support table in two stages of their operation;

FIG. 13 is a view in cross-section through a hold-down means with bent individual portions;

FIG. 14 is an alternative embodiment of a hold-down means;

Referring to FIG. 1, the various individual portions 3 are first prepared in a stack-wise manner on a stacking station 5. In that connection the stacks are already in the correct position relative to each other but they are not absolutely precisely aligned. The individual portions 3 of a layer are lifted jointly from the stacking station and deposited on the positioning station 4. As indicated in broken lines, after being deposited, those individual portions are in the same relative position with respect to each other as at the stacking station 5. The individual portions of the layer on the positioning station are then pushed towards each other until the layer represents a structure which is closed in itself. In that connection, preferably an individual portion, for example a centre limb, is fixed or oriented at least in relation to a given axis, while all other individual portions are pushed theretowards. The finally positioned individual layer is then transported in a closed condition from the positioning station 4 to the laminating station 2 and is there exactly deposited or laminated to form a laminated body as indicated at 1. In that connection, there are no longer any lateral force components acting on the individual layers which have already been laminated as there is no longer any need for positioning of the individual portions. The operation of precisely depositing the positioned individual layers on the laminating station may be effected with simple means.

Figure 2:
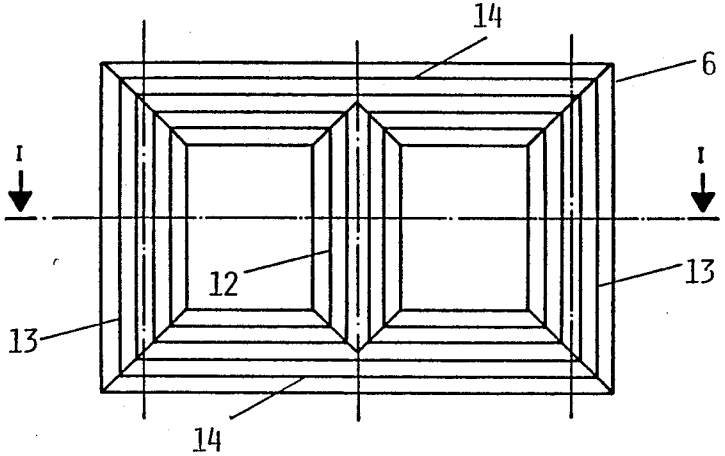
FIG. 2 is a plan view of the core of a multi-stage three-phase transformer.
Figure 3:
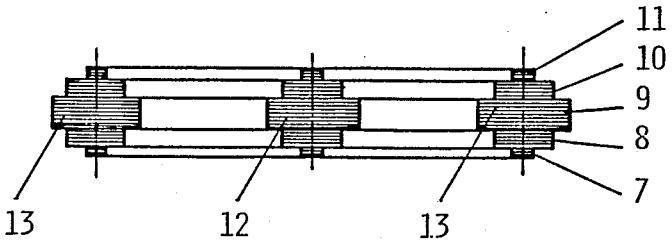
FIG. 3 is a view in cross-section taken along line I—I of the core shown in FIG. 2.

The process is suitable in a particularly advantageous manner for the laminating of transformer cores, in particular of three-phase transformers. It will be appreciated however that laminated bodies as are used in part in structural engineering or in mechanical engineering may also be constructed in the same fashion. Different forms may also be envisaged in regard to the configuration of the transformer cores. Thus it is possible for example to laminate a multi-stage core of a three-phase transformer, as shown in FIGS. 2 and 3. It will be appreciated however that single-phase transformers of the core or shell type or even complicated five-limb transformers may also be produced in that way. It will also be seen that the core cross-sections may be modified as desired. It is also possible to produce core cross-sections with cooling slots, depending on the situation of use involved. The junctions between the individual portions may be butt junctions or mortise junctions, while the ends of the individual portions may be cut at a right angle or on the slant.

FIGS. 2 and 3 show by way of example a typical core 6 of a three-phase transformer with a stepped cross-section, which is made up of the central limb 12, the two outer limbs 13 and the two yokes 14. The ends of the individual portions are bevel-cut at an angle of 45°. The cross-section of the core is a five-stage cross-section and is composed of the first and fifth stages 7 and 11, the second and fourth stages 8 and 10 and the middle and third stage 9.

Figure 4:
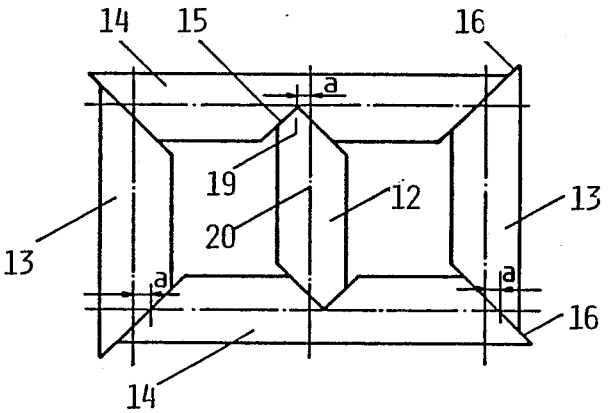
FIG. 4 is a plan view of an individual layer with displaced junctions.
Figure 5:
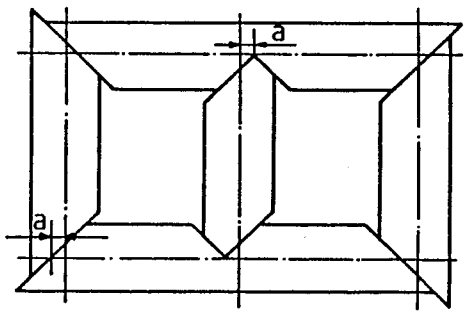
FIG. 5 is a plan view of a layer adjoining the layer shown in FIG. 4, with alternately displaced junctions.

FIGS. 4 and 5 show the arrangement of the individual portions of a respective pair of successive layers, in greater detail. In order to minimise the magnetic losses within the cores, the individual succesive layers are stacked in mutually displaced relationship relative to each other. In the case of the three-limb core, that is achieved in a very simple manner by the central limb 12 having a tip or point 19 which is arranged in displaced relationship by a dimension a, with respect to the centre line 20. The yokes 14 are provided with a V-shaped cut 15 which is arranged at the centre of a respective yoke. When the yokes 14 are pushed against the central limb 12 with the displaced tips or points 19, that provides in a very simple manner that the junctions between the yokes and the outer limbs 13 are also in displaced relationship. FIG. 4 shows a layer with the upper yoke displaced towards the left relative to the centre line 20. In the next following layer as shown in FIG. 5, the central limb 12 is arranged in a reverse position in regard to the sides thereof, so that the point or tip 19 of the limb 12 is displaced by the dimension a to the right of the centre line 20. That correspondingly gives an upper yoke 14 which is displaced towards the right. A core consists of layers which are displaced in themselves, as shown in FIGS. 4 and 5. That alternate structuring of the core is known per se and will no longer be expressly referred to in the following description.

Figures 6, 6A, 6B, 6C, 6D, 7, 7A, 7B, 7C, 7D, 7E:
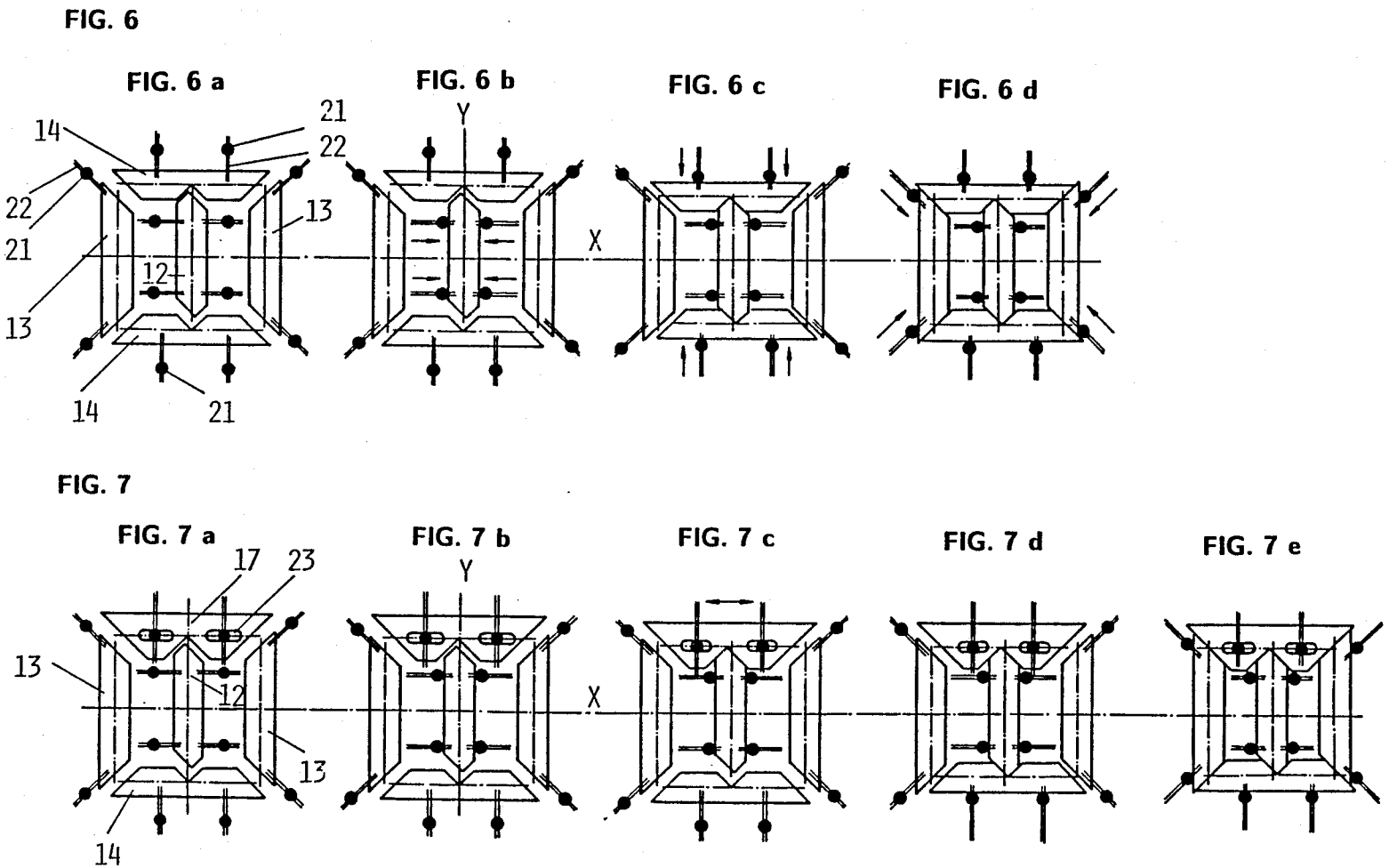
FIGS. 6*a*–6*d* show the operation of positioning a layer as shown in FIGS. 4 and 5.
FIGS. 7*a*–7*e* show the positioning operation for a layer which is open at one side, with a gauge or positioning yoke.

FIG. 6 shows the operations involved in the positioning of a layer for a three-limb core. The positioning procedure is effected using pushing elements 21 which are displaceable in grooves 22. In FIG. 6*a* the individual portions are shown in their basic position which corresponds to the position on the above-mentioned stacking station 5. In a first step, the central limb 12 is aligned with respect to the axis of symmetry Y by means of the pushing elements 21, and held in that position, as shown in FIG. 6*b*. However the central limb may move freely on the Y-axis, which is possibly further facilitated by rolling members on the pushing elements. In a next step as shown in FIG. 6*c*, the two yokes 14 are moved with an axially symmetrical movement relative to the axis of symmetry X and thus brought into contact against the central limb 12, with a certain force. The layer is now oriented both with respect to the Y-axis and also the X-axis. Finally, in a last step as shown in FIG. 6*d*, the outer limbs 13 are also individually brought into a condition of abutting against the yokes 14, by a parallel movement relative to the axis of symmetry Y. In that operation fluctuations in tolerance in the length of the various individual portions are automatically compensated, thus resulting in junctions without any gap. The layer when finally positioned in that way is then passed to a suitable apparatus at the laminating station, for laminating the core.

FIG. 7 shows the operations for positioning a layer for the production of a core which is open at one side. In that procedure, arranged at the positioning station is a gauge or positioning yoke 17 which performs the function of the second yoke. In the case of the yoke 17, the pushing elements 21 engage into longitudinal slots 23, so that the yoke 17 can move laterally relative to the axis of symmetry Y. As FIG. 7*a* shows, the individual portions are again first deposited at the positioning station. The central limb 12 is then oriented and held on the Y-axis, as shown in FIG. 7*b*. As shown in FIG. 7*c*, the yoke 17 is then first moved to its appropriate position. Depending on whether the tip of the central limb is displaced towards the left or towards the right, the yoke 17 may be displaced towards the right or towards the left in the slots 23. In the next step as shown in FIG. 7*d*, the yoke 14 is moved parallel to the X-axis until it abuts against the central limb 12, with a certain force. Finally the two outer limbs 13 are individually pushed into position, in parallel relationship, as shown in FIG. 7*e*. When the positioned layer is lifted off, it will be seen that the positioning yoke 17 remains on the positioning station so that a core which is open at one side is produced at the laminating station.

Figure 8:
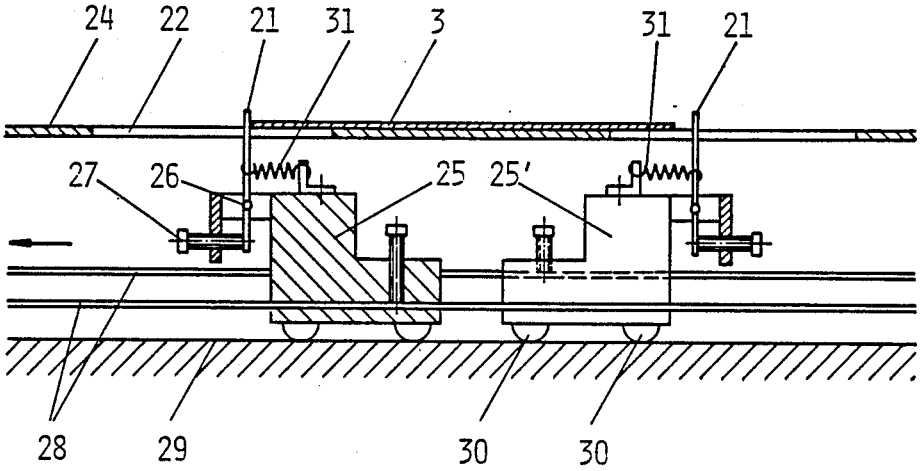
FIG. 8 is a view in cross-section through a support table with a pushing arrangement disposed therebeneath.

The structure and the mode of operation of a pushing arrangement will now be described in greater detail with reference to FIGS. 8 to 10. As already briefly mentioned above, the positioning station 4 has a support table 24 which is provided with grooves 22 in which the pushing elements 21 which project above the table are displaceable. FIG. 8 is a view in cross-section through an individual groove with an individual portion 3 supported on the support table 24. The individual pushing elements 21 are mounted pivotably on a shaft or spindle 26 which in turn is fixed to a pushing carriage or truck 25. The pushing elements 21 are biassed in the pushing direction thereof by a spring 31 and can be adjusted by means of a stop screw 27. The carriages 25 are secured to a parallel motion cable 28 and move on rollers 30 on a linear guide 29.

Figure 9:
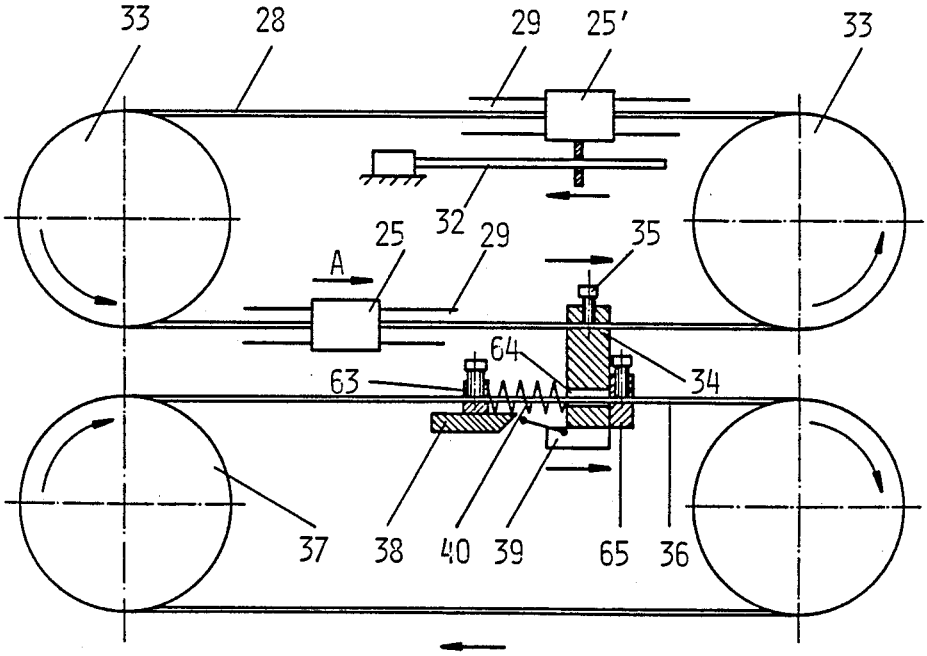
FIG. 9 is a highly simplified plan view of the apparatus shown in FIG. 8.

As FIG. 9 in particular shows, the cable 28 is tensioned by means of guide rollers 33. A respective carriage 25 and 25' is fixed to each straight portion of the cable 28. When the cable 28 is driven in one direction of rotation, it will be seen that the two carriages 25 and 25' are moved towards and away from each other respectively. That produces an axially symmetrical movement which is used for pushing the plate portions into position.

The cable 28 is driven by way of a drive cable 36 which is arranged in parallel relationship to the cable 28. The drive cable 36 is driven by a motor (not shown) at a constant speed of rotation, by way of a drive wheel 37. The connection between the drive cable 36 and the parallel motion cable 28 is made by way of an entrainment member 34 which is fixed to the parallel motion cable 28 by means of a cable clamp 35. The entrainment member 34 is mounted resiliently relative to the drive cable, by a spring 40 being arranged between the cable clamp 63 on the drive cable 36 and the entrainment member 34. The drive cable 36 is guided through a bore 64 on the entrainment member 34. The spring 40 may be prestressed by the cable clamp 65. Fixedly secured to the drive cable 36 by the cable clamp 63 is a cam 38 for activating a switch 39 on the entrainment member 34. When the plate portions on the support table 24 are pushed together, the entrainment member 34 pulls the parallel motion cable 28 in the direction indicated by the arrow A so that the two pushing carriages 25 and 25' move towards each other. As soon as the portion 3 has been brought into position and can no longer be further moved on the support table 24, the carriages 25 and 25' are braked, by the springs 31 at the pushing elements 21 being stressed. As soon as the cable 28 has been brought to a halt as a result, the entrainment member 34 moves relative to the drive cable 36 which continues to move. When that occurs, the spring 40 which has a lower spring rate than the springs 31 is compressed until the cam 38 actuates the switch 39. The switch 39 brings the drive wheel 37 to a halt.

When the pushing elements 21 are in the pushed-together position, a measuring apparatus 32 as shown in diagrammatic form in FIG. 9 is preferably actuated. The measuring apparatus may be an incremental or an absolute measuring system. The measuring system is used to determine the position of the pushing elements 21, and that position is transmitted to a monitoring apparatus. The monitoring apparatus compares the detected values, for example the width of the central limb and the position of the pushing members for pushing the yoke or yokes and the side limbs, to predetermined values, and triggers a fault signal if there are deviations as between the actual dimension and the reference dimension.

The drive wheel 37 is reversed for the purposes of opening the pushing elements, until the carriages 25 and 25' have reached an opening position which is detected by way of the measuring system 32. The drive wheel 37 is then stopped and the positioning station is ready for a further pushing operation.

Figure 10:
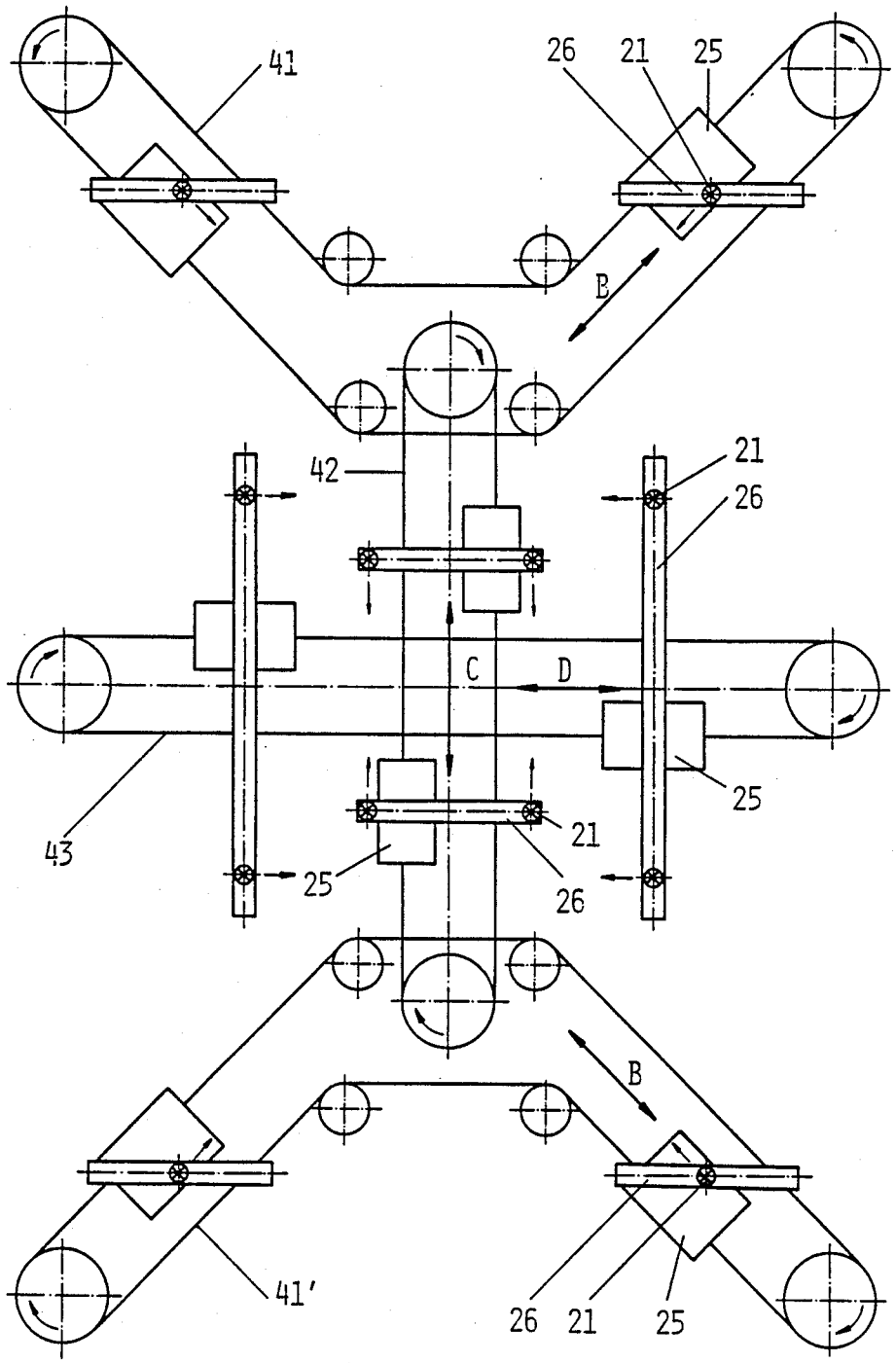
FIG. 10 is a highly simplified plan view of a pushing arrangement for positioning a layer as shown in FIGS. 6*a*–6*d;*
Figure 15:
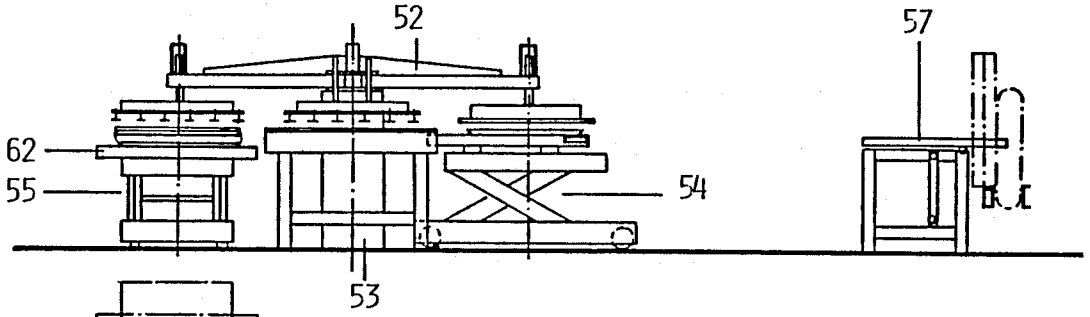
FIG. 15 is a side view of a laminating apparatus with a swinging turning unit.

FIG. 10 shows the combination of a plurality of parallel motion cables as is necessary for example for the pushing operation shown in FIG. 6. References 41 and 41' indicate the two cable runs for pushing the outer limbs into position. The only difference in relation to the parallel motion cable shown in FIG. 9 is that the two pushing elements 21 do not move towards each other in parallel relationship but at an inclined angle, but parallel to the X-axis. In other respects the drive by means of a drive cable is precisely the same, but it is not shown in FIG. 10 in order to enhance the clarity of the drawings. The pushing elements 21 of the cable runs 41 move in the direction indicated by the arrow B.

Reference 42 denotes the cable run for the central limb. Here, two pushing elements 21 are fixed in pairs to a respective pushing carriage 25 by way of the respective shaft or spindle 26, and move towards or away from each other in pairs, in the direction indicated by the arrow C.

The cable run 43 for pushing the yokes into position is of the same construction as the cable run 42 but is arranged displaced through 90° relative thereto. The pushing elements 21 of the cable run 43 move in the direction indicated by the arrow D. It will be appreciated that the individual cable runs are arranged under the support table 24 in such a way that they do not impede each other. Depending on the number of individual portions to be positioned, still further cable runs with parallel motion cables could be arranged beneath the support table. It will be appreciated however that the pushing elements 21 could also be operated in another manner, for example with contra-rotating spindles, pneumatic cylinders or the like actuating elements.

FIGS. 11 and 12 relate to the gripper apparatus. As shown in FIG. 11, a movable suction gripper 44 is used for lifting the individual plates from the stacking station 5. The ends of each plate are bent up when lifted. In that arrangement, for each individual portion, the gripper has a plurality of resiliently mounted gripper arms 46 and at least one bellows 45. The gripper arms 46 and the bellows 45 are connected to a vacuum source by way of a conduit 66. The gripper arms 46 are provided with suction heads 49 on their under-sides while the bellows 45 has a suction lip which is not shown in greater detail. FIG. 11*a* shows the position of the gripper directly prior to being applied to the stack at the stacking station 5. When the gripper is lowered on to the stack, all suction heads 49 and the bellows 45 are pressed against the uppermost portion, as shown in FIG. 11*b*. As soon as a vacuum has been produced by way of the conduit 66, the suction heads 49 and the bellows 45 suck an individual portion 3 thereagainst. When that happens, the bellows 45 is contracted so that it lifts on end of the plate. That overcomes the adhesion forces at the plate and air can flow under the bent-up portion of the plate. FIG. 11*c* shows the beginning of the lifting operation. FIG. 11*d* shows that the individual portions 3 are transported from the stacking station 5 to the positioning station 4, not in a plane-parallel condition but in a slightly bent-up condition. That does not cause any further harm however as the individual portions do not have to be deposited on the positioning station in a precisely defined position.

In order to ensure that, when the individual portions are pushed into position on the positioning station, the bent-up ends thereof are not pushed one over the other, the arrangement preferably uses a hold-down means 50, as shown in FIG. 13. The hold-down means 50 is preferably integrated into the gripper apparatus. It provides that any bent-up ends of the individual portions 3 are held down in such a way that they cannot be pushed one over the other when the portions are pushed into position on the support table 24. As FIG. 14 shows, it is possible in that respect to use spacer pins 51 which respectively provide for a minimum air gap between the flat individual portions 3 and the underside of the hold-down means 50.

FIG. 12 shows a gripper apparatus having a rigid gripper plate 48 as is used for transporting a positioned layer from the positioning station 4 to the laminating station 2. The support table 24 is structured by means of depressions 47 so that virtually no adhesion forces can occur when lifting a layer off the table. The gripper plate itself is preferably also structured so that when the layer is deposited at the laminating station 2, it does not remain clinging to the gripper plate 48.

The gripper apparatus with the integrated hold-down means is lowered on to the positioning station. It is positioned thereon and then the layer is sucked into position. That ensures absolutely precise transportation to the laminating station, without the individual portions being shifted.

The overall arrangement of a laminating apparatus according to the invention will now be described with reference to FIGS. 15 to 19.

Figure 16:
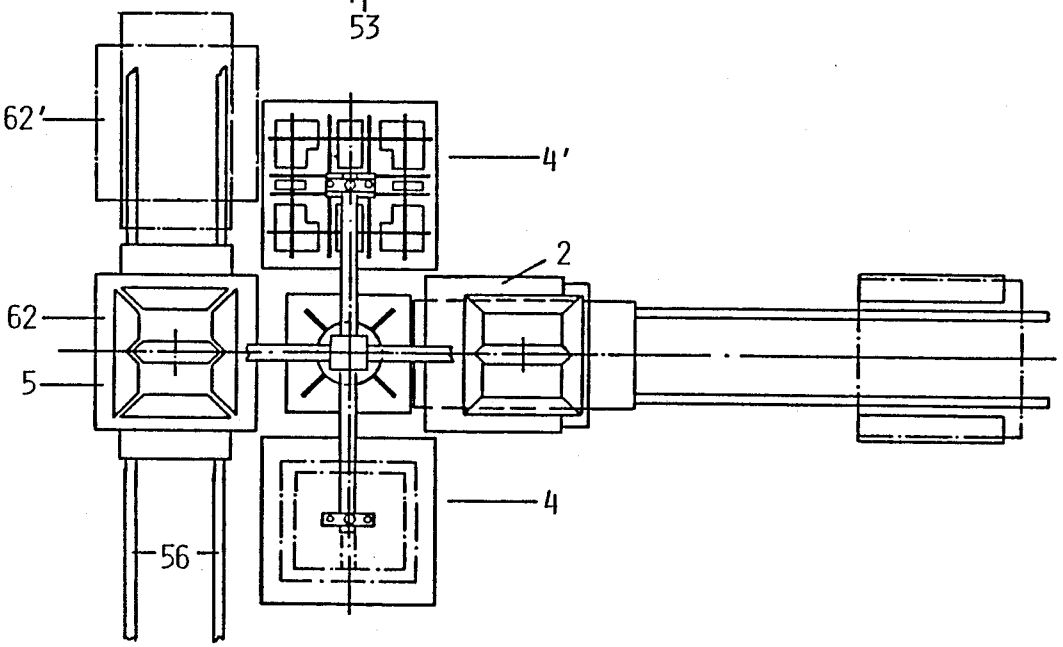
FIG. 16 is a plan view of the apparatus shown in FIG. 15.

Four grippers which are each in displaced relationship through 90° relative to each other are arranged at a turning unit 52 in the form of a cross. The grippers are first plate gripper 60, a second plate gripper 61, a first layer gripper 58 and a second layer gripper 59. The turning unit 52 is mounted on a central column 53 and is rotatable thereabout. Arranged around the central column 53, and also displaced relative to each other through 90°, are a stacking station 5, two positioning stations 4 and 4' and a laminating station 2. The two stations 4 and 4' are arranged in diametrally mutually opposite relationship. Various stacking tables 62 and 62' can be selectively moved to the stacking station 5 on rails 56. The stacking tables 62 are arranged on rolling carriages 55. As shown in FIG. 16, the stacking table 62 is disposed at the stacking station 5 while the stacking table 62' is in a waiting position directly therebeside. Individual portions of different widths can be prepared on the stacking tables 62, for the various stages of a transformer core. It will be appreciated that, as an alternative to the linear delivery movement of the stacking tables 62, it would also be possible to provide a rotary table which delivers the respective suitably prelaminated stack of a given dimension to the stacking station 5. The height of the stacking table 62 is adjustable and can be adapted to the respective stack height.

Figures 17, 18, 19:
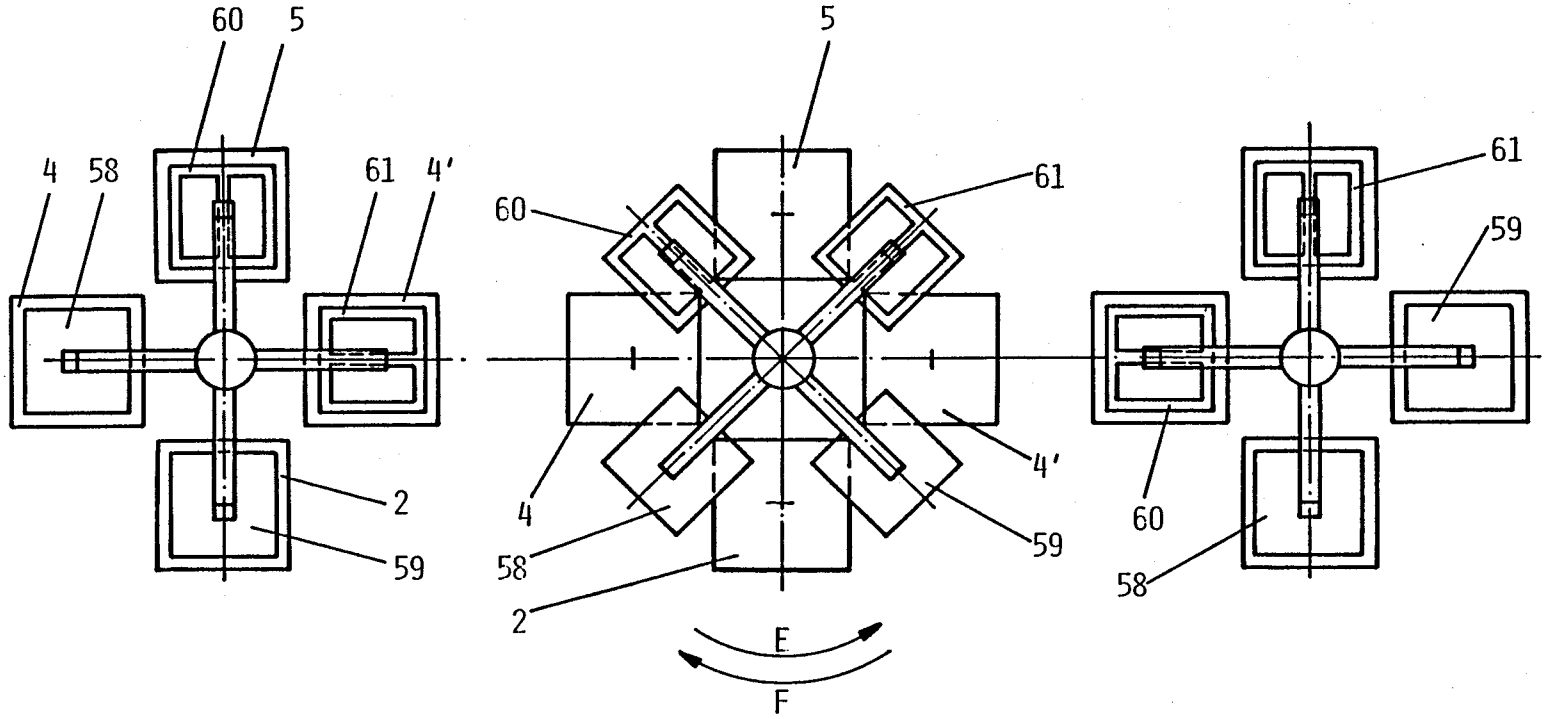
FIGS. 17 to 19 show the various operating cycles of the apparatus shown in FIGS. 15 and 16.

The laminating station 2 comprises a pantograph-like table 54 which is also movable and whose height can be adapted to the respective core to be laminated. After the end of the laminating operation the table 54 can be moved to the tipping station 57 where the laminated core can be set upright for further processing. FIGS. 17 to 19 show the various automated operating cycles when laminating the core at the laminating station 2. In the position shown in FIG. 17, a plate layer is picked up from the stacking station 5 by the first plate gripper 60. At the same time, a finally positioned layer is picked up from the positioning station 4 by the first layer gripper 58. The second plate gripper 61 lays a plate layer which has been previously picked up at the stacking station 5, on the second positioning station 4' and the second layer gripper 59 lays a finally positioned layer which has been previously picked up at the positioning station 4', on the laminating station 2.

For the next operating cycle, the turning unit 52 moves in the direction indicated by the arrow E until the unit 52 is in the position shown in FIG. 19. In that position, the first plate gripper 60 lays its layer which has been previously picked up from the stacking station 5, on the positioning station 4 which is now empty, while the second plate gripper 61 picks up a fresh layer at the stacking station 5. At the same time the first layer gripper 58 lays its layer which it had picked up from the positioning station 4, on the laminating station 2, and the second layer gripper 59 picks up the positioned layer from the positioning station 4'. For the next working cycle the unit 52 is turned back again in the direction indicated by the arrow F so that it is again in the position shown in FIG. 17. The pick-up and lay-down operation for the various layers can begin afresh. Thus, with each pivoting or swinging movement, a layer is transported from the stacking station to a positioning station or from a positioning station to the laminating station. It will be appreciated that, instead of the rotary conveyor movement, it would also be possible to envisage a linear movement with stations which are arranged in succession. The apparatus provides an optimum rationalisation effect in that the costs of laminating a core are up to five times lower, in comparison with manual lamination. The installation may be operated in a practically fully automatic manner so that an operator is required only for the preparation operations or when a fault occurs. Different lengths of yokes and limbs may be stacked in the installation, without substantial conversion operations being required. Different nominal dimensions in respect of the abutment positions may be preprogrammed in a control apparatus so that the operator only has to select the program which corresponds to the desired core configuration.

We claim:

1. A process for producing laminated plate packs consisting of individual layers each having a plurality of portions that abut against each other, the process comprising depositing the portions of one individual layer on a positioning station having a generally horizontal even support table, positioning said deposited portions on said support table in relative contiguous positions by pushing the portions together in the plane of the support table to form an individual layer of predetermined shape, and delivering said individual layer when formed to a laminating station while maintaining said predetermined shape, and laminating the individual layer with at least one other individual layer on the laminating station by repeating the process in order to build up the plate pack on the laminating station.

2. A process according to claim 1, including initially positioning individual portions of a plurality of substantially similar layers in stacks on a stacking station, each said stack containing substantially similar portions and said stacks being oriented relatively to each other similarly to subsequent orientation required of their respective individual portions when positioned in a layer on said positioning station, and transporting individual portions so oriented respectively from said stacks to said positioning station.

3. A process according to claim 1, in which said positioning of individual layer portions comprises locating one of said individual portions in a predetermined location on said positioning station and pushing the others of said individual portions to form said layer of contiguous portions arranged in a predetermined shape in a position on said positioning station located by the location of said one portion.

4. A process according to claim 3, for forming a laminated plate pack constituting a transformer core having three parallel limbs and two yokes substantially perpendicular to said limbs and connected to the ends of said limbs at their opposite ends, said core consisting of layers each having three parallel portions and two yoke portions respectively constitutind layers of said limbs and yokes, said positioning of individual layer portions comprising first orienting a centre one of said parallel portions with respect to a predetermined axis on said positioning station, pushing said yoke portions intermediate their ends to abut respectively against opposite ends of said centre one of said parallel portions, and then pushing the outer ones of said three parallel portions each respectively to abut against two ends respectively of said two yoke portions.

5. A process according to claim 3, for forming a laminated plate pack constituting a transformer core having a yoke and three limbs projecting in parallel from said yoke, said limbs being free at their end remote from said yoke and said core consisting of layers each having a yoke portion and three parallel portions, said positioning of individual layer portions comprising first orienting the centre one of said three parallel portions with respect to a predetermined axis on said positioning station, pushing a gauge yoke to abut against one end of said centre one of said parallel portions, pushing said yoke portion to abut against the other end of said centre one of said parallel portions, and then pushing the outer ones of said three parallel portions each respectively to abut against ends respectively of said yoke portion and said gauge yoke.

6. A process according to claim 3, for forming a laminated plate pack constituting a transformer core having three parallel limbs and a pair of yokes substantially perpendicular to said limbs and abutting the ends of said limbs at their opposite ends, said core consisting of layers each having three parallel portions and two yoke portions respectively constituting layers of said limbs and yokes, said positioning of said individual layer portions comprising first orienting a centre one of said parallel portions with respect to a predetermined axis on said positioning station, pushing said pair of yoke portions to abut intermediate their ends respectively against opposite ends of said centre one of said parallel portions, and then pushing the pair of portions constituting the outer ones of said three parallel portions each respectively to abut against two ends respectively of said pair of yoke portions, the portions in at least one of said pairs being pushed with an axially symmetrical movement.

7. A process according to claim 3, including using a monitoring apparatus for measuring at least one parameter of said layer of contiguous portions, arranged in a predetermined shape, and noting any signal emitted by said apparatus indicating a measurement value differing from a nominal value.

8. A process according to claim 2, in which said transportation of said individual portions from said stacks to said positioning station is effected by operating a movable gripper to bend individual portions to overcome adhesion forces, to thereupon lift the individual portions from said stacks and subsequently deposit said individual portions on said positioning station.

9. A process according to claim 2, in which said delivery of said layer when formed to said laminating station is effected by rigid gripper in a plane-parallel condition, while maintaining the relative positions of said individual portions in said layer.

* * * * *